US006210070B1

(12) United States Patent
Shaw et al.

(10) Patent No.: US 6,210,070 B1
(45) Date of Patent: Apr. 3, 2001

(54) CONCRETE DOWEL SLIP TUBE WITH CLIP

(76) Inventors: Ron D. Shaw, 1401 Outrigger, Corona Del Mar, CA (US) 92625; Lee A. Shaw, 2672 Crestview Dr., Newport Beach, CA (US) 92663

( * ) Notice: Subject to any disclaimer, the term of this patent is extended or adjusted under 35 U.S.C. 154(b) by 0 days.

(21) Appl. No.: 09/291,528

(22) Filed: Apr. 14, 1999

(51) Int. Cl.[7] ..... E01C 5/08
(52) U.S. Cl. ..... 404/70; 404/65; 404/62
(58) Field of Search ..... 14/73.1; 404/47, 404/60, 61, 62, 63, 64, 70, 134

(56) References Cited

U.S. PATENT DOCUMENTS

| | | | | |
|---|---|---|---|---|
| 1,045,562 | | 11/1912 | Kennedy . | |
| 1,592,681 | | 7/1926 | Grothe . | |
| 1,631,576 | * | 6/1927 | Bawers | 404/59 |
| 1,728,936 | | 9/1929 | Johnson . | |
| 1,838,635 | | 12/1931 | Pilj . | |
| 1,852,673 | | 4/1932 | Pilj . | |
| 1,939,007 | | 12/1933 | Heltzel | 25/118 |
| 2,095,060 | | 10/1937 | Geyer | 94/18 |
| 2,129,568 | | 9/1938 | De Biasi | 72/122 |
| 2,262,704 | | 11/1941 | Tompkins et al. | 72/128 |
| 2,269,703 | * | 1/1942 | Bagwill | 404/62 |
| 2,275,272 | | 3/1942 | Scripture, Jr. | 25/154 |
| 2,277,203 | | 3/1942 | Boult | 94/24 |
| 2,296,453 | | 9/1942 | Saffert | 25/155 |
| 2,319,526 | | 5/1943 | Wearn | 72/128 |
| 2,331,949 | | 10/1943 | Whiteman | 72/128 |
| 2,365,550 | | 12/1944 | Heltzel | 94/18 |
| 2,373,284 | | 4/1945 | Autrey | 72/128 |
| 2,508,443 | | 5/1950 | Carter | 94/18 |
| 2,636,426 | | 4/1953 | Heltzel | 94/51 |
| 2,746,365 | | 5/1956 | Darnielle | 94/33 |
| 2,823,539 | | 2/1958 | Kersh et al. | 72/128 |
| 3,066,448 | | 12/1962 | Pinter | 50/80 |
| 3,279,335 | * | 10/1966 | Garner | 404/61 |
| 3,284,973 | | 11/1966 | Ames et al. | 52/155 |
| 3,333,380 | | 8/1967 | Wolf | 52/365 |
| 3,437,017 | * | 4/1969 | Walz et al. | 404/60 |
| 3,451,179 | | 6/1969 | Kendzia | 52/370 |
| 3,896,599 | | 7/1975 | Werstein et al. | 52/704 |
| 3,920,221 | | 11/1975 | Berry et al. | 256/59 |
| 3,921,356 | | 11/1975 | Hughes | 52/299 |
| 4,115,976 | | 9/1978 | Rohrer | 52/741 |
| 4,146,599 | | 3/1979 | Lanzetta | 264/35 |

(List continued on next page.)

FOREIGN PATENT DOCUMENTS

| | | |
|---|---|---|
| 568457 | 10/1975 | (CH) . |
| 79813 | 8/1955 | (DK) . |
| 1094449 | 11/1953 | (FR) . |

*Primary Examiner*—Eileen D. Lillis
*Assistant Examiner*—Raymond W Addie
(74) *Attorney, Agent, or Firm*—Kit M. Stetina; Stetina Brunda Garred & Brucker

(57) ABSTRACT

A concrete dowel placement apparatus for use with continuous pour concrete slabs comprising at least one slip tube, a concrete support dowel insertable into a respective slip tube and a wire mesh supporting structure. The slip tube comprises an elongate tubular sheath with a closed end, and an open end for slidable insertion of the concrete support dowel. Additionally, attached to an exterior surface of the sheath is a clip which is engagable to the wire mesh support structure. Therefore, the slip tube is attachable to the wire mesh structure such that the dowel is positionable within a continuous pour concrete slab at a prescribed location. The slip tube provides lateral movement of the dowel within the slab to thereby prevent fracturing of the slab in areas near sawcuts. The support structure may be formed from different configurations to facilitate positioning of the slip tubes and respective concrete support dowels supported therein. A support foot is further provided to maintain the dowel in the prescribed position during pouring of the concrete slab.

15 Claims, 3 Drawing Sheets

U.S. PATENT DOCUMENTS

| | | | | |
|---|---|---|---|---|
| 4,158,937 | | 6/1979 | Henry | 52/365 |
| 4,261,496 | | 4/1981 | Mareydt et al. | 224/315 |
| 4,329,080 | * | 5/1982 | Elley | 404/64 |
| 4,437,828 | | 3/1984 | Egger | 425/458 |
| 4,496,504 | | 1/1985 | Steenson et al. | 264/69 |
| 4,533,112 | | 8/1985 | Santos, Jr. et al. | 249/3 |
| 4,578,916 | | 4/1986 | Witschi | 52/396 |
| 4,614,070 | | 9/1986 | Idland | 52/296 |
| 4,648,739 | | 3/1987 | Thomsen | 404/2 |
| 4,748,788 | | 6/1988 | Shaw et al. | 52/742 |
| 4,752,153 | | 6/1988 | Miller | 404/59 |
| 4,800,702 | | 1/1989 | Wheeler | 52/677 |
| 4,883,385 | | 11/1989 | Kaler | 404/47 |
| 4,899,497 | | 2/1990 | Madl, Jr. | 52/126.6 |
| 4,926,593 | | 5/1990 | Johnston | 52/126.4 |
| 4,938,631 | | 7/1990 | Maechtle et al. | 52/235 |
| 4,959,940 | | 10/1990 | Witschi | 52/396 |
| 4,996,816 | * | 3/1991 | Wiebe | 404/134 |
| 5,005,331 | | 4/1991 | Shaw et al. | 52/396 |
| 5,134,828 | | 8/1992 | Baur | 52/704 |
| 5,216,862 | | 6/1993 | Shaw et al. | 52/396 |
| 5,301,485 | | 4/1994 | Shaw et al. | 52/678 |
| 5,678,952 | | 10/1997 | Shaw et al. | 404/62 |
| 5,713,174 | * | 2/1998 | Kramer | 404/60 |

* cited by examiner

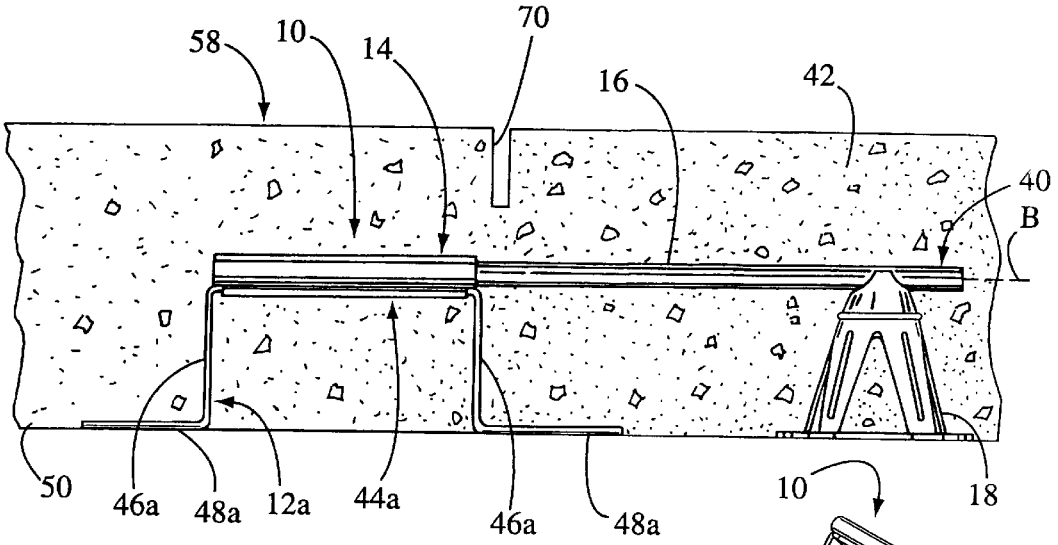
Fig. 3
Fig. 4
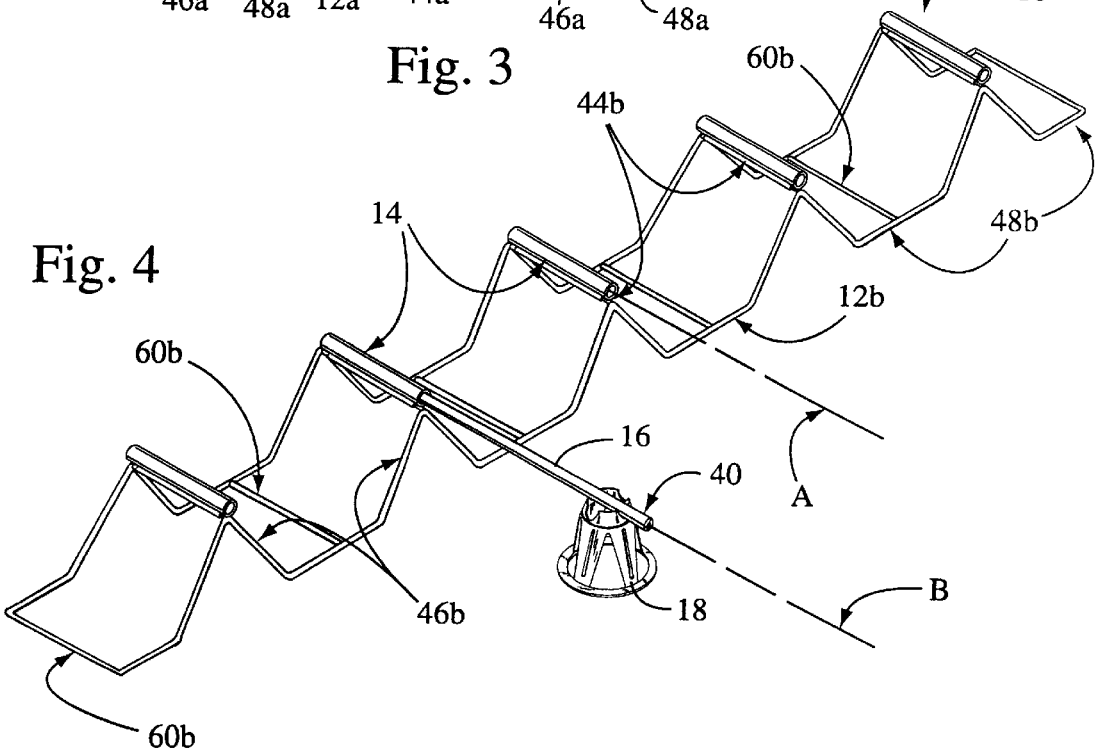

CONCRETE DOWEL SLIP TUBE WITH CLIP

BACKGROUND OF THE INVENTION

The present invention generally relates to the art of concrete construction, and more particularly to a device for facilitating the placement of slip dowel rods within a concrete slab.

In the art of concrete construction, it is commonplace to form "cold joints" between two or more poured concrete slabs. Such cold joints frequently become uneven or buckled due to normal thermal expansion and contraction of the concrete and/or compaction of the underlying soil caused by inadequate substrate preparation prior to pouring of the concrete. As a means of preventing buckling or angular displacement of such cold joints, it is common practice to insert smooth steel dowel rods generally known as "slip dowels" within the edge portions of adjoining concrete slabs in such a manner that the concrete slabs may slide freely along one or more of the slip dowels, thereby permitting linear expansion and contraction of the slabs while at the same time maintaining the slabs in a common plane and thus preventing undesirable buckling or unevenness of the cold joint and in adjacent slabs.

In order to function effectively, slip dowels must be accurately positioned parallel within the adjoining concrete slabs. The non-parallel positioning of the dowels will prevent the desired slippage of the dowels and will defeat the purpose of the "slip dowel" application. Additionally, the individual dowels must be placed within one or both of the slabs in such a manner as to permit continual slippage or movement of the dowels within the cured concrete slab(s).

It is commonplace to form large concrete slabs using monolithic or continuous concrete pour methods. Such slabs are formed by continuously pouring large quantities of concrete without the use of forms or cold joints in order to reduce costs. Therefore, fracturing of the slab is prevented by including tooled joints or sawcuts in the slab where cold joints would otherwise be needed. Additionally, concrete reinforcement material such as wire mesh or segments of rebar are initially placed into the area in which the continuous pour is to be made, and in particular those areas where it is contemplated that sawcuts will be included in the resultant slab for purposes of preventing fracturing thereof. The wire mesh or other reinforcement material is preferably elevated above ground level by the placement thereof upon support blocks or "chairs".

In addition to having concrete reinforcement material disposed within those portions of the slab in which a sawcut is to be made, it is also desirable to incorporate slip dowels into such portions to allow the separate sections of the slab which are defined by the sawcuts to move relative to each other while preventing any buckling or angular displacement thereof. One prior art method of incorporating slip dowels into those areas of a continuous pour where sawcuts are contemplated involves manually "stabbing" the slip dowels into predetermined locations of the uncured concrete pour. This method, however, is deficient in that there is no way to insure that the slip dowels will be manually positioned within the uncured concrete in parallel relation to each other, or will be maintained in parallel alignment to the top surface of the concrete pour during curing. As previously explained, if the dowel rods are not in parallel alignment, the separate sections of slab as defined by the sawcuts will be prevented from moving relative to each other.

Another prior art method of incorporating slip dowels into a monolithic pour involves manually tieing the slip dowels to the reinforcement material in parallel relation to each other prior to the concrete pour being made. Manual tieing, however, is extremely time consuming and presents significant difficulties in securing the slip dowels to the reinforcement material in true parallel relation to each other. Additionally, the tied slip dowels are susceptible to displacement or shifting when impacted by the concrete during the pour thus moving the same out of parallel alignment with each other.

The present invention addresses and overcomes the above-described deficiencies of prior art slip dowel placement in continuous concrete pours by providing a device that places slip dowels accurately during the pouring of such concrete slabs. In this respect, the present invention places slip dowels into a concrete slab through the use of slip tubes that are easily attached to a prefabricated support structure. Therefore, the present invention provides an accurate and easy system for slip dowel placement in a monolithic pour.

BRIEF SUMMARY OF THE INVENTION

In accordance with the present invention, there is provided a concrete dowel slip tube for attachment to a wire mesh support structure. The slip tube comprises an elongate, tubular dowel receiving sheath having a proximal end, a distal end, an exterior surface and a hollow interior compartment extending longitudinally therein. The hollow interior compartment that is sized and configured to receive a concrete support dowel. The interior compartment has a generally circular cross-sectional configuration with a diameter between about 0.5 inches and about 1.0 inches. The longitudinal length of the sheath is between about 6.0 inches and about 30.0 inches.

Attached longitudinally to the exterior surface of the sheath is a clip sized and configured to frictionally retain the wire mesh support structure. The clip has a first prong portion and a second prong portion that define an arcuately contoured recess that is engagable to the support structure. The clip extends longitudinally along at least one-half the length of the sheath or from about the distal end to about the proximal end.

There is additionally provided a concrete dowel placement apparatus comprising a wire mesh support structure placeable upon a support surface and the concrete dowel slip tube previously described. The support structure comprises a base portion and an elevated portion having a plurality of top segments which extend in spaced, generally parallel relation to each other for attachment of the clip of a respective slip tube. Each of the top segments is configured to be in generally co-planar relationship to each other. Typically each top segment is elevated to a height of between about 2.5 inches and about 24 inches and spaced between about 6.0 inches and 30.0 inches between one another.

In a first embodiment of the support structure the elevated portion comprises a plurality of side segments which extend generally perpendicularly relative to respective ones of the top segments. Additionally, the base portion includes a plurality of base segments which extend generally perpendicularly to respective ones of the side segments. In a second embodiment of the placement apparatus the elevated portion of the support structure comprises a plurality of V-shaped members attached to the base portion and arranged to define multiple opposed pairs. Each of the V-shaped members define an apex such that each of the top segments are attached to and extend between the apices of a respective pair of V-shaped members.

The placement apparatus may be in further combination with an elongate concrete support dowel. The concrete support dowel is slidably insertable into the concrete dowel slip tube such that an end of the support dowel extends therefrom. A support foot may be further included in the placement apparatus of the present invention. The support foot is sized and configured to receive and support the end of the dowel extending from the slip tube and coaxially maintain the dowel in such position. As such, the interior compartment of the sheath defines a first axis and the dowel defines a second axis that is coaxially alignable with the first axis when the dowel is inserted into the interior compartment. The support foot is formed to be of a height which maintains the coaxial alignment of the first and second axes when the dowel support foot is placed upon the support surface and interfaced to the end of the dowel protruding from the sheath.

The present invention further comprises a method of supporting a monolithic concrete pour through the use of a placement apparatus having a support structure, multiple slip tubes having open ends and multiple support dowels. The method comprises attaching the slip tubes to the support structure such that the slip tubes extend in generally parallel alignment with each other. Next, the support structure is placed at a prescribed location on a support surface and the support dowels are inserted into open ends of respective ones of the slip tubes such that at least a portion of each of the support dowels protrudes from a respective one of the slip tubes. The concrete is then poured around the slip tubes and the exposed portions of the support dowels to encapsulate the same and form a monolithic concrete slab. Finally, a sawcut is made in the concrete slab along an axis perpendicular to the axes of the slip tubes. The sawcut may be formed such that the axis of the cut is extended along and in spaced relation to the open ends of the slip tubes. The slip tubes may be attached subsequent to the placing of the support structure and a support foot may be attached to each support dowel after sliding the dowel within the slip tube.

BRIEF DESCRIPTION OF THE DRAWINGS

These, as well as other features of the present invention, will become more apparent upon reference to the drawings wherein:

FIG. 3 is a cross-sectional view of the concrete dowel slip tube and wire mesh support structure shown in FIG. 1 in an operative position within a monolithic concrete pour;

FIG. 4 is a perspective view of the present concrete dowel slip tube as used in conjunction with a support foot of the present invention and a wire mesh support structure constructed in accordance with a second embodiment thereof;

DETAILED DESCRIPTION OF THE INVENTION

Figure 1:
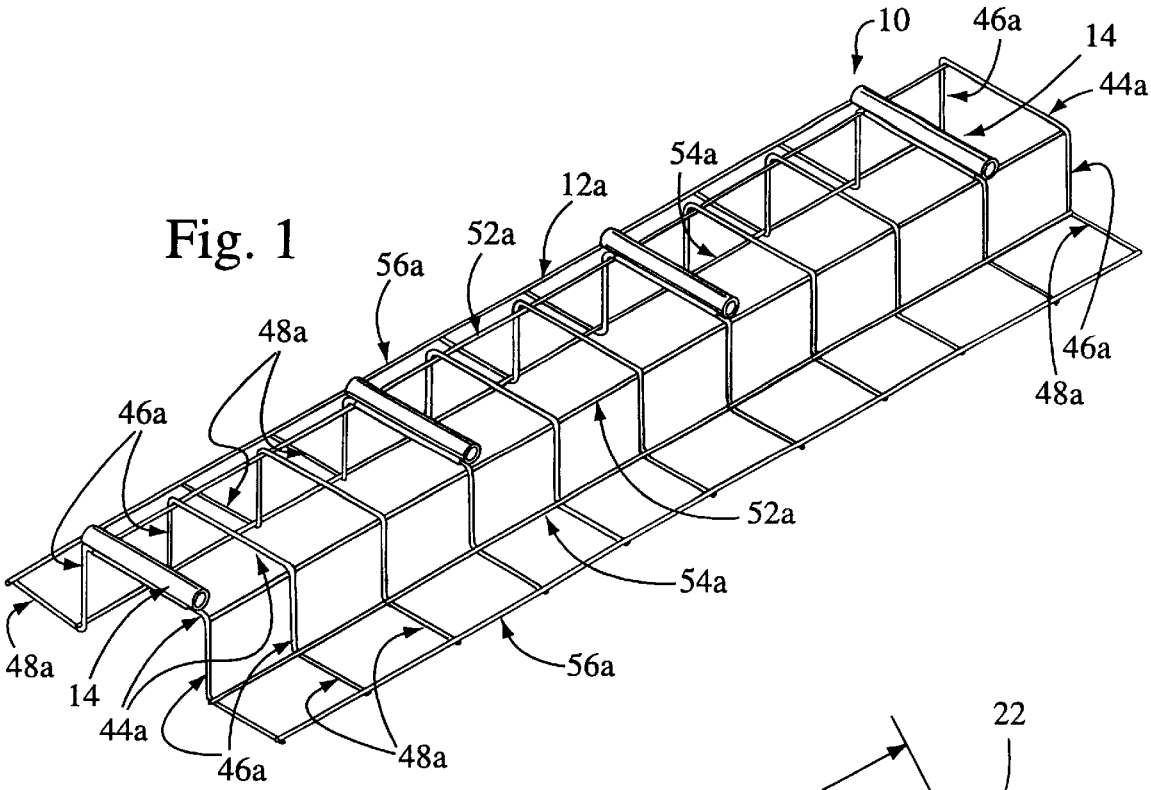
FIG. 1 is a perspective view of a concrete dowel slip tube of the present invention as used in conjunction with a wire mesh support structure constructed in accordance with a first embodiment thereof.

Referring now to the drawings wherein the showings are for purposes of illustrating preferred embodiments of the present invention only, and not for purposes of limiting the same, FIG. 1 perspectively illustrates a concrete dowel placement apparatus 10 for use with monolithic or continuous pour concrete construction techniques. The placement apparatus 10 comprises a wire mesh support structure 12*a* constructed in accordance with a first embodiment of the present invention and at least one concrete dowel slip tube 14 attached thereto. As seen in FIG. 3, the concrete dowel placement apparatus additionally comprises a concrete support dowel 16 and a dowel support foot 18.

CONCRETE DOWEL SLIP TUBE AND SUPPORT DOWEL

Figure 2:
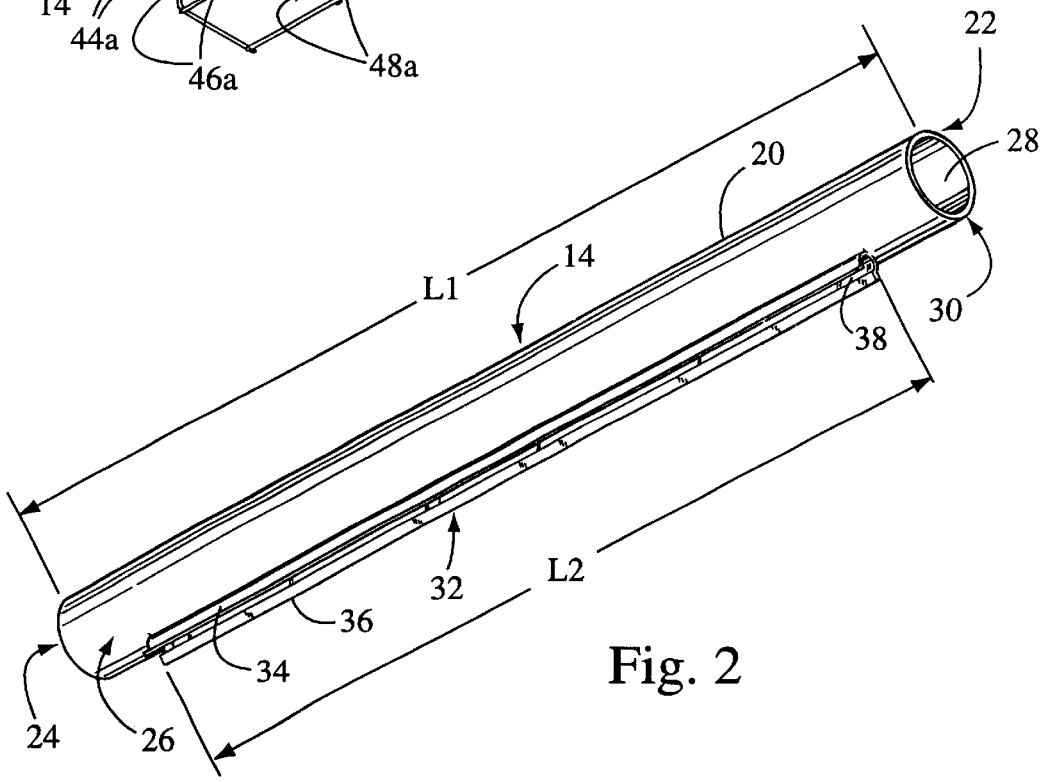
FIG. 2 is a bottom perspective view of the concrete dowel slip tube shown in FIG. 1.

The slip tube 14 constructed in accordance with the present invention is used for supporting the concrete support dowel 16 slidably insertable therein. As seen in FIG. 2, the slip tube 14 is constructed from an elongate, tubular sheath 20 with an open proximal end 22 and a closed distal end 24. The sheath 20 has a generally circular cross-sectional area with an exterior surface 26, and an inner surface 28 which defines a hollow, longitudinally extending interior compartment 30 therewithin. Typically, the longitudinal length "L1" of the sheath 20 is between about 6.0 inches and about 30.0 inches. The interior compartment 30 is sized slightly larger than the outer diameter of the concrete support dowel 16. The outer surface 26 of sheath 20 may further be provided with ribs or ridges (not shown) to facilitate frictional retention as will be further explained below.

Mounted on the exterior surface 26 of the sheath 20 is a clip 32 used to releasably attach the slip tube 14 to the wire mesh support structure 12*a*. The clip 32 can be integrally connected to sheath 20 (i.e., formed from the same plastic material) or attached to the exterior surface 26 thereof. The clip 32 comprises a first prong 34 and a second prong 36 that collectively define an arcuately contoured recess 38 which is sized and configured to receive a section of the wire mesh support structure 12*a*. The prongs 34 and 36 are fabricated from a flexible material such that receipt of the wire mesh support structure 12*a* into the recess 38 facilitates a slight outward flexation of prongs 34, 36 and frictional retention thereof to support structure 12*a*. The clip 32 preferably has a length "L2" that is at least one-half the length "L1" of the sheath 20 in order to provide the necessary frictional retention to support the dowel 16. The clip 32 retains the slip tube 14 in a position whereby the concrete support dowel 16 inserted therein is supported in a prescribed position as will be further explained below.

Referring now to FIG. 3, the support dowel 16 is sized such that it is slidably insertable into the interior compartment 30 of the sheath 20. The sheath 20 is typically fabricated from a plastic material such that the support dowel 16 may freely slide therewithin. The support dowel 16 extends outwardly from the open end 22 of sheath 20 such that an extended end 40 of dowel 16 is firmly adhered by a concrete slab 42 poured thereover. The dowel 16 may be fabricated from a section of rebar or other type of material with the necessary strength to prevent buckling or angular displacement of the concrete slab 42, as will be further explained below. Additionally, the dowel 16 may be formed with ribs or ridges (not shown) on an exterior surface thereof to facilitate frictional retention within the concrete slab 42.

PREFERRED EMBODIMENTS OF THE WIRE MESH SUPPORT STRUCTURE

As seen in FIG. 1, a first embodiment of the wire mesh support structure 12*a* comprises a plurality of elevated portions 43*a* having top segments 44*a* and side segments 46*a*. Attached in generally perpendicular relationship to the elevated portions 43*a* are a plurality of base portions 48*a*. In order to form the first embodiment of the support structure 12*a*, two side segments 46*a*, 46*a* are attached perpendicularly to a respective end of the top segment 44*a* such that each side portion 46*a*, 46*a* projects downwardly toward a ground surface 50 and forms a generally U-shaped elevated portion 43*a*. Furthermore, in the first embodiment, two base portions 48*a*, 48*a* are attached generally perpendicularly to a respective end of each side segments 46*a*, 46*a* such that each base portion 48*a*, 48*a* is disposed in generally parallel relation to the ground surface 50. Each base portion 48*a* provides a stable support foundation for each side segment 46*a* and top segment 44*a* attached thereto.

The first embodiment of the wire mesh support structure 12*a* additionally comprises two top stringers 52*a*, 52*a*, two side stringers 54*a*, 54*a* and two base stringers 56*a*, 56*a* as seen in FIG. 1. Each top stringer 52*a* is attached to the elevated portion 43*a* such that each top segment 44*a* is substantially parallel to one another as is required for proper operation. Each side stringer 54*a* is attached to either elevated portion 43*a* or base portion 48*a*. Similarly, each base stringer 56*a* is attached to the outermost ends of each base portion 48*a*.

The first embodiment of the support structure 12*a* may be fabricated from concrete reinforcing wire. Each top segment 44*a*, side segment 46*a*, 46*a*, and bottom portion 48*a*, 48*a*, may be formed from a single section of concrete reinforcing wire by bending such material into the desired generally U-shaped configuration. Then the top 52*a*, side 54*a* and base 56*a* stringers may be welded at their respective locations in order to from the support structure 12*a*.

Figure 6:
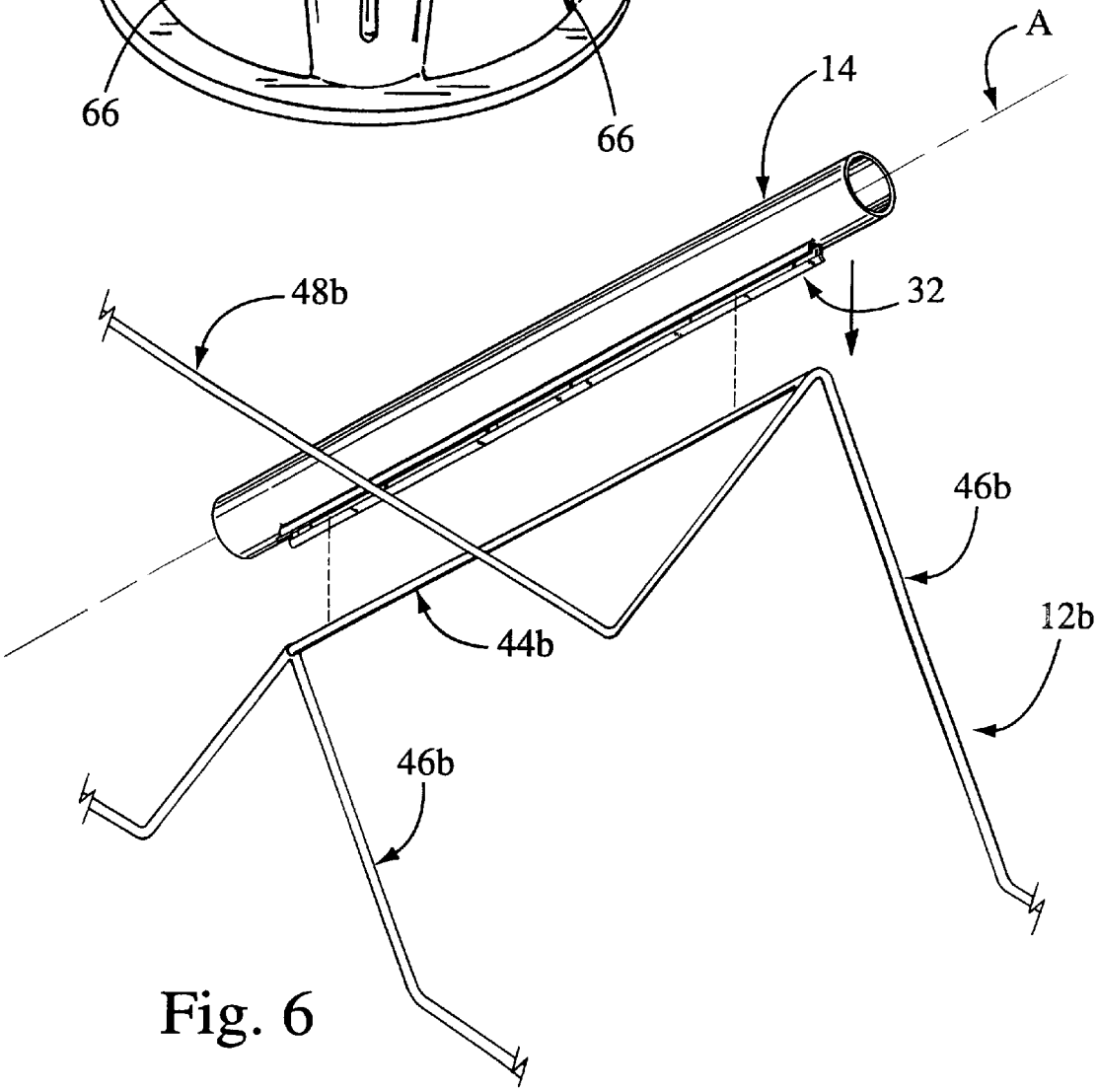
FIG. 6 is an exploded view illustrating the manner in which the concrete dowel slip tube is secured to the wire mesh support structure of the second embodiment as shown in FIG. 4.

Referring now to FIGS. 4 and 6, a second embodiment of a wire mesh support structure 12*b* can also support slip tubes 14 and is formed from a plurality of top segments 44*b*, generally V-shaped side segments 46*b* and base portions 48*b* inter-connected together. As seen in FIG. 4, each end of the top segment 44*b* is connected to an apex of the V-shaped side segment 46*b* in order to elevate the top segment 44*b* and form elevated portion 43*b*. Each side segment 46*b* is then attached to the base portion 48*b*. Therefore, as seen in FIG. 4, the plurality of base portions 48*b* are attached to the plurality of side segments 46*b* such that the side segments 46*b* are connected in a linear fashion side-by-side. A respective top segment 44*b* provides support to the apex of each V-shaped side segment 46*b* and spacers 60*b* attached to base portions 48*b* midway between two adjacent side segments 46*b*, 46*b*. The second embodiment of the support structure 12*b* can be formed by bending two, long segments of concrete reinforcing wire into two generally sawtooth configurations comprising base portions 48*b* and side segments 46*b*. Then both sawtooth configurations of reinforcement wire are attached, typically through a weld, to top segments 44*b* and spacers 60*b* to form support structure 12*b*.

Each support structure 12*a* and 12*b* is configured to maintain a plurality of concrete dowel slip tubes 14 in a substantially parallel relationship to one another and parallel to a top surface 58 of concrete slab 42. Additionally, the support structure 12*a* and 12*b* maintains the slip tubes in substantially coplanar relationship. Therefore, each top segment 44*a* or 44*b* is attached to a respective side segment 46*a* or 46*b* such that each top portion is in parallel alignment with each other. Additionally, side segments 46*a* and 46*b* are sized such that each respective top segment 44*a* or 44*b* is elevated above the ground 50 in the same plane. Therefore, each side segment 44*a* or 44*b* has a length of between about 2.5 inches to about 24.0 inches. Each top segment 44*a* or 44*b* is sized to receive the clip 32 of slip tube 14. As such, the length of the top segment 44*a* or 44*b* is between about 6.0 inches to about 30.0 inches and are spaced along the support structure between about 6.0 to about 30.0 inches.

CONCRETE DOWEL SUPPORT FOOT

Figure 5:
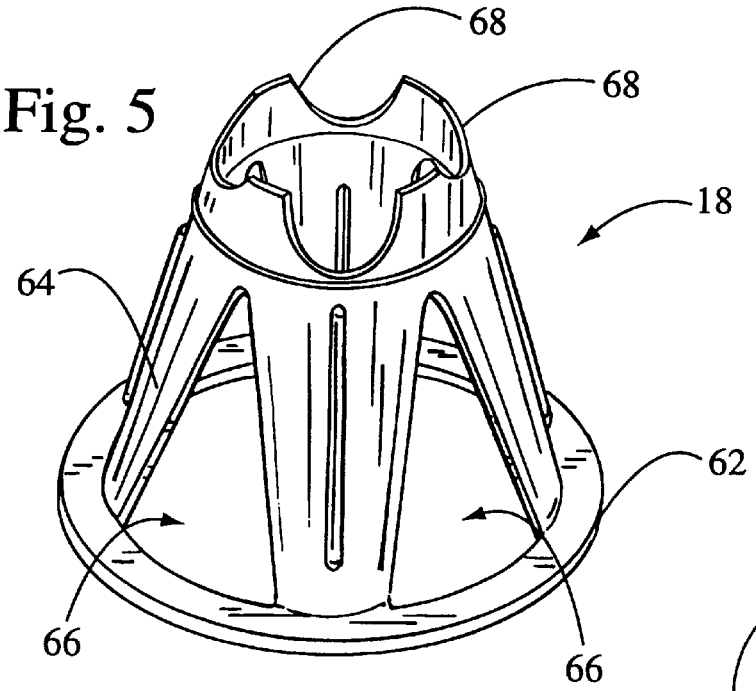
FIG. 5 is a top perspective view of the support foot shown in FIG. 4.

The concrete dowel placement apparatus 10 additionally comprises the support foot 18 as shown in FIGS. 3, 4 and 5. The support foot 18 supports the extended end 40 of support dowel 16. As seen in FIG. 5, the support foot 18 comprises a generally annular base portion 62 that supports a frustum shaped wall 64. The wall 64 is provided with a plurality of openings 66 for access to the interior of the support foot 18 during pouring of concrete. Referring to FIGS. 4 and 5, the support foot 18 is sized and configured to receive the support dowel 16 in at least one of a plurality of dowel engagers 68 formed about a top of the base portion 62. The dowel engagers 68 are sized with an interior diameter slightly smaller than the outside diameter of the support dowel 16 in order to frictionally engage the support dowel 16. Therefore, an engager 68 can "snap" onto the extended end 40 of support dowel 16.

PREFERRED PLACEMENT METHODOLOGY

Now having described the components of the concrete dowel placement apparatus 10, the function and method of using each component will be explained. Reference to the first embodiment of the support structure 12*a* will be made herein, yet it will be recognized that the second embodiment of support structure 12*b* can be interchanged with the first embodiment in the following description of use. First, slip tubes 14 are attached to the top segments 44*a* of the support structure 12*a* via clip 32 as previously described. The slip tubes 14 are typically spaced about 6.0 to 30.0 inches between adjacent members. Therefore, the slip tubes 14 can be placed on top segments 44*a* in any spacing configuration that achieves the desired distance between themselves. As seen in FIG. 1, the slip tubes 14 are attached to every fourth top segment 44*a*, however in FIG. 4, the slip tubes 14 are attached to every top segment 44*b*.

Next, the support structure 12*a* is positioned in the location where a sawcut 70 will be made in the monolithic concrete slab 42 after pouring and curing thereof. As seen in FIG. 3, the support structure 12*a* is placed upon the ground surface 50 that supports the concrete slab 42. The base portions 48*a* are substantially flush with the surface 50 in order to prevent tripping of workmen during pouring of the concrete slab 42. Next, The support structure 12*a* is positioned to place a central axis "A" of the slip tubes 14 perpendicular to where sawcut 70 will be made after pouring of the concrete. Additionally, the support structure 12*a* is positioned such that the central axis "A" of the slip tubes 14 is parallel to the top surface 58 of concrete slab 42 after pouring thereof. As will be recognized to those of ordinary skill in the art, it is also possible to position the support structure 12*a* on ground surface 50 before the slip tubes 14 are attached thereto. As such, once the support structure 12*a* is in proper position and location, the slip tubes 14 are attached to top segments 44*a* as needed.

Before the concrete slab 42 is poured, the concrete support dowels 16 are inserted within a respective slip tube 14. As previously described above, the support structure 12*a* is configured to support the slip tubes 14 and support dowels 16 inserted therein in a substantially parallel and co-planar relationship to one another, and parallel to the top surface 58 of concrete slab 42. The support dowels 16 are slidable within a respective slip tube 14 in order to provide lateral displacement of the concrete slab 42 as will be further explained below. The extended end 40 of dowel 16 projects outwardly from the slip tube 14 such that the support structure 12*a* may become imbalanced and tend to tip toward surface 50. If this happens, then support foot 18 is attached to the extended end 40 of dowel 16 to provide additional support thereto. The support foot 18 has a height which coaxially aligns a central axis "B" of support dowel 16 with the central axis "A" of slip tube 14 when support dowel 16 is attached to a respective dowel engager 68 of foot 18. The dowel 16 must be easily slidable within the slip tube 14 for proper operation. Therefore, the central axis "A" of slip tube 14 must be coaxially aligned with the central axis "B" of support dowel 16 in order to prevent binding of the dowel 16 within tube 14 which may be caused since the sheath 20 is slightly larger than the diameter of the support dowel 16. Additionally, support foot 18 aligns axis "B" of support dowel 16 to axis "A" of slip tube 14 during pouring of the concrete because the weight of the concrete can cause the support dowel to bend and therefor bind on sheath 20. The weight of the concrete being poured onto dowel 16 may further act as a lever arm to pop the clip 32 off of the top segment 44*a*. As such, the support foot 18 provides support to extended end 40 to maintain slip tube 14 in parallel alignment with top segment 44*a* and to prevent clip 32 from releasing.

After having placed the dowels 16 into respective slip tubes 14, the concrete slab 42 is formed by pouring concrete around the support structure 12*a*. The concrete encapsulates the support structure 12*a*, the exposed portion of the support dowel 16 and the foot 18 (if used). Since the foot 18 is provided with openings 66 formed therein, the concrete is able to fully surround and encapsulate foot 18. Therefore, foot 18 (if used) can remain in place after the concrete has cured. Typically, the height of the support structure 12*a* is chosen to position the support dowels 16 midway between the top surface 58 of concrete slab 42 and the supporting ground surface 50.

After the concrete slab 42 has cured, the sawcut 70 is formed on the top surface 58 of concrete slab 42 by sawing the slab 42 with standard concrete construction techniques. The sawcut 70 is located perpendicular to the central axis "A" of the slip tubes 14. Additionally, the sawcut 70 must be located at the junction where the support dowel 16 enters the slip tube 14 (i.e., near the open end 22 of sheath 20). Since the dowel 16 is longitudinally slidable within the slip tube 14, the concrete slab 42 may be laterally displaced about sawcut 70. The portion of the support dowel 16 extending within the slip tube 14 is allowed to move freely in a longitudinal direction, whereas the portion of the dowel 16 extending into the concrete slab 42 is frictionally retained therein. The closed end 24 of sheath 20 prevents the seepage of concrete thereinto such that the portion of dowel 16 within the slip tube 14 is freely slidable in a generally horizontal direction. Therefore, the sawcut 70 is placed at the junction between the dowel 16 and slip tube 14 since this is the location whereby the dowel 16 is freely slidable horizontally. However, the dowel 16 is not movable in a vertical direction within slab 42 because it is encapsulated by concrete or retained within slip tube 14. Therefore, the dowel 16 can prevent buckling or angular displacement of concrete slab 34 in the area whereby dowel 16 is positioned.

The present invention accurately positions concrete support dowels 16 during the pouring of the monolithic concrete slab 42. As such, the positioning and configuration of the slip tubes 14 can be easily and quickly changed by varying the size of slip tube 14 and corresponding concrete support dowel 16, as well as the size of the slip tube support structure. Since it is preferable to fabricate both the first and second embodiments of the slip tube supporting structure (i.e., support structure 12*a* or 12*b*) from concrete reinforcing wire, the structures can be modified very quickly. For example, the length of the structures can be decreased by trimming the structures at a desired location. As such, the present invention provides an adaptable system for quickly and easily placing concrete support dowels 16 before pouring a concrete slab 42.

Additional modifications and improvements of the present invention may also be apparent to those of ordinary skill in the art such as varying the configuration of the slip tube support structure 12*a* or 12*b* as well as other configurations for the clip 32 of slip tube 14. Thus, the particular combination of parts described and illustrated herein is intended to represent only certain embodiments of the present invention, and is not intended to serve as limitations of alternative devices within the spirit and scope of the invention.

What is claimed is:

1. A concrete dowel slip tube assembly for use with a wire mesh support structure in maintaining planar constancy of a cured concrete slab, the assembly comprising:

a) an independent elongate tubular sheath member having a length dimension and comprising a continuous wall having a constant thickness throughout and forming a tubular hollow interior compartment having a constant cross-sectional dimension substantially throughout, said tubular sheath member having a closed distal end and an open proximal end opening into said compartment, and further with said wall having a clip attached thereto and extending longitudinally along the sheath member, said clip sized to extend along at least one-half of said length dimension and configured to frictionally retain said wire mesh support structure; and b) an independent dowel member slidingly engageable within the hollow interior compartment, said dowel having a length dimension and a constant cross-sectional dimension wherein said length dimension and said cross sectional dimensions are less than said length and the cross sectional dimension of the hollow interior compartment, with said dowel having an external configuration complimentarily substantially identical to the hollow interior compartment of the sheath member.

2. A concrete dowel slip tube assembly as claimed in claim 1 wherein the clip extends longitudinally on the sheath member from about the distal end of the sheath member to the proximal end of the sheath member.

3. A concrete dowel slip tube assembly as claimed in claim 2 wherein the clip comprises first and second opposing prongs which define an arcuately contoured recess therebetween engageable to the wire mesh support structure.

4. A concrete dowel slip tube assembly as claimed in claim 1 wherein the clip comprises first and second opposing prongs which define an arcuately contoured recess therebetween engageable to the wire mesh support structure.

5. A concrete dowel slip tube assembly as claimed in claim 1 wherein the sheath member has a length of between about six inches and 30 inches.

6. A concrete dowel slip tube assembly as claimed in claim 1 wherein the interior compartment has a generally circular cross-sectional configuration and is of a diameter from about 0.5 inch to about 1.0 inch.

7. A concrete dowel placement apparatus comprising:

a) a wire mesh support structure placeable upon a support surface; and b) a concrete dowel slip tube assembly comprising:

i) an independent elongate tubular sheath member having a length dimension and comprising a continuous wall having a constant thickness throughout and forming a tubular hollow interior compartment having a constant cross-sectional dimension substantially throughout, said tubular sheath member having a closed distal end and an open proximal end opening into said compartment, and further with said wall having a clip attached thereto and extending longitudinally along the sheath member, said clip sized to extend along at least one-half of said length dimension and configured to frictionally retain said wire mesh support structure; and ii) an independent dowel member slidingly engageable within the hollow interior compartment, said dowel having a length dimension and a constant cross-sectional dimension wherein said length dimension and said cross sectional dimension are less than said length dimension and said cross sectional dimension of the hollow interior compartment, with said dowel having an external configuration complimentarily substantially identical to the hollow interior compartment of the sheath member.

8. The placement apparatus of claim 7 wherein the wire mesh support structure comprises:

a base portion for placement upon the support surface; and an elevated portion including a plurality of top segments which extend in spaced, generally parallel relation to each other;

the placement apparatus including a plurality of sheath members whose clips are attachable to respective ones of the top segments.

9. The placement apparatus of claim 8 wherein the top segments are generally co-planar.

10. The placement apparatus of claim 9 wherein each of the top segments is elevated to a height of between about 2.5 inches and about 24.0 inches above the support surface when the base portion is placed thereupon.

11. The placement apparatus of claim 9 wherein the top segments are spaced from each other at intervals of between about 6.0 inches and about 30.0 inches.

12. The placement apparatus of claim 8 wherein the elevated portions of the wire mesh support structure comprises:

a plurality of V-shaped members attached to the base portion and arranged to define multiple opposed pairs, each of the V-shaped members defining an apex;

each of the top segments being attached to and extending between the apices of a respective pair of the V-shaped members.

13. The placement apparatus of claim 8 wherein:

the elevated portion includes a plurality of side segments which extend generally perpendicularly relative to respective ones of the top segments; and the base portion includes a plurality of base segments which extend generally perpendicularly relative to respective ones of the side segments.

14. The placement apparatus of claim 7 further comprising a dowel support foot sized and configured to receive and support an end of the dowel member when extending from the interior compartment of the sheath member.

15. The placement apparatus of claim 14 wherein:

the interior compartment of the sheath member defines a first axis;

the dowel member defines a second axis that is coaxially alignable with the first axis when the dowel member is inserted into the interior compartment; and the dowel support foot is formed to be of a height which maintains the coaxial alignment of the first and second axes when the dowel member is inserted into the interior compartment and the dowel support foot is placed upon the support surface and interfaced to the end of the dowel member protruding from the sheath member.

* * * * *